US010934724B2

(12) United States Patent
Gorton

(10) Patent No.: US 10,934,724 B2
(45) Date of Patent: Mar. 2, 2021

(54) TILE LEVELLING DEVICE

(71) Applicant: LEVTEC SYSTEMS PTY LTD, Mayfield West (AU)

(72) Inventor: Michael Gorton, Mayfield West (AU)

(73) Assignee: LEVTEC SYSTEMS PTY LTD, Mayfield West (AU)

( * ) Notice: Subject to any disclaimer, the term of this patent is extended or adjusted under 35 U.S.C. 154(b) by 0 days.

(21) Appl. No.: 16/623,340

(22) PCT Filed: Jun. 14, 2018

(86) PCT No.: PCT/AU2018/050591
§ 371 (c)(1),
(2) Date: Dec. 16, 2019

(87) PCT Pub. No.: WO2018/227250
PCT Pub. Date: Dec. 20, 2018

(65) Prior Publication Data

US 2020/0173181 A1 Jun. 4, 2020

(30) Foreign Application Priority Data

Jun. 14, 2017 (AU) ..... 2017902267

(51) Int. Cl.
*E04F 21/00* (2006.01)

(52) U.S. Cl.
CPC ..... *E04F 21/0092* (2013.01)

(58) Field of Classification Search
CPC ..... E04F 21/0092; E04F 21/20; E04F 21/22; E04F 21/1877; E04F 13/0892; E04F 15/02022
See application file for complete search history.

(56) References Cited

U.S. PATENT DOCUMENTS 8,429,879 B1 * 4/2013 Hoffman ..... E04F 21/0092 52/747.11
8,671,628 B2 3/2014 Sighinolfi
9,470,003 B1 * 10/2016 Moon ..... E04F 21/20
9,482,018 B2 * 11/2016 Torrents I Comas ..... E04F 21/0092
9,945,133 B2 * 4/2018 Hoffman ..... E04F 13/0889
9,970,203 B1 * 5/2018 Abidov ..... E04F 21/0092
D885,862 S * 6/2020 Bacia ..... D8/47
(Continued)

FOREIGN PATENT DOCUMENTS

CA 2892352 A1 11/2016
WO 2001/121476 A1 10/2011

OTHER PUBLICATIONS

International Search Report and Written Opinion as received in PCT/AU2018/050591 dated Jun. 27, 2018.

*Primary Examiner* — James M Ference
(74) *Attorney, Agent, or Firm* — Keller Jolley Preece

(57) ABSTRACT

A tile levelling device (10) includes a base portion (12) having an upper surface (14) and an opposing lower surface (16), the lower surface (16) being substantially planar; two stems (20) each having a proximal end frangibly connected to the base portion (120) and a distal end connected to a body (32), a generally rectangular hole (34) being defined by the stems (20) the base portion upper surface (14) and the body (32), the hole (34) being adapted to receive a wedge (50); and a stiffening formation (70) located at or near the interface between each stem (20) and the body (32).

8 Claims, 5 Drawing Sheets

(56) References Cited

U.S. PATENT DOCUMENTS

2008/0236094 A1* 10/2008 Doda ..... E04F 21/22
52/749.11
2012/0023766 A1* 2/2012 Hillebrandt ..... E04F 21/22
33/527
2013/0055675 A1* 3/2013 Sighinolfi ..... E04F 15/02022
52/749.11
2013/0067854 A1* 3/2013 Bordin ..... E04F 15/02022
52/749.11
2014/0033640 A1* 2/2014 Gorton ..... E04F 21/0092
52/747.11
2014/0116001 A1* 5/2014 Ghelfi ..... E04F 21/0092
52/749.11
2014/0298736 A1* 10/2014 Bunch ..... E04F 21/0092
52/126.1
2014/0325936 A1* 11/2014 PSaila ..... E04F 21/0092
52/749.11
2015/0211243 A1* 7/2015 Irvine ..... E04F 21/22
52/126.1
2015/0308130 A1* 10/2015 Biec ..... E04F 21/0092
52/749.11
2016/0186449 A1* 6/2016 Lee ..... E04F 21/1877
33/527
2016/0222679 A1* 8/2016 Bunch ..... E04F 21/1844
2018/0291640 A1* 10/2018 Sighinolfi ..... E04F 21/20
2019/0063084 A1* 2/2019 Bunch ..... E04F 13/0892
2019/0169863 A1* 6/2019 Torrents Comas .....
E04F 15/02022
2020/0173181 A1* 6/2020 Gorton ..... E04F 21/0092

* cited by examiner

TILE LEVELLING DEVICE

TECHNICAL FIELD

The present invention relates to a tile levelling device. In particular, the present invention relates to a device for levelling and spacing tiles during installation. However, it will be appreciated that the device may be applied to other applications.

BACKGROUND OF THE INVENTION

When laying tiles, it is important that the tiles are laid evenly relative to the adjacent tiles. If the tiles are laid inconsistently, the finished job may be visually unsightly. In addition, if sufficient space is not provided between adjacent tiles, the tiles may not be able to expand or contract on account of thermal or moisture changes.

In order to lay tiles evenly, the tiler should take into account the space between adjacent tile, making sure that the spaces are consistent and of uniform thickness. Another important factor is that the upper surfaces of the tiles should be laid on the same plane as far as possible, so that the matrix of tiles has the appearance of being flat and consistent. Alternatively, in the scenario where this is not possible, for example where there is fall in the floor to accommodate drainage, then the adjacent edges should, as far as possible, be set to the same height to avoid a "step" occurring between adjacent tiles edges. Such steps may reduce the overall visual quality of the finished job, and may possibly create a trip hazard or restrict water flow.

Tiles are typically laid manually and spaced using small disposable plastic crosses or other such spacers. Whilst this is suitable for spacing the tiles, the issues of "flatness" of the matrix of tiles is not addressed by this technique. Flatness is typically achieved by experience, and this can be difficult to achieve. The tiler must consider variables such as the amount of tile adhesive to use, variations between batches of tile adhesive, the flatness of the underlying floor or wall surface and inconsistencies in the underlying floor or wall surface.

Various methods of spacing and levelling tiles are available. In recent years, there has been a trend toward clip and wedge systems. Generally, these systems utilises a base portion which is placed under the edge portions of two adjacent tiles during laying. The base portion is connected to a stem which extends between the two adjacent tiles. A hole is formed in the stem and the hole is located above the tile upper surfaces. A wedge is driven into the hole by force before the tile adhesive has set to pull the upper edges of the tiles into alignment, and the amount of force applied can be selectively varied, such that the user can customise the edge alignment force.

At a later period of time, after the tile adhesive has set, the wedges are removed and the stem is snapped off by force using a mallet, kicking or by other such impact. The snapping occurs at a frangible region located on the stem, where the stem attaches to the base portion.

One disadvantage with these existing clip and wedge systems relates to the thickness of the stem. If the stem is too thick, it will result in the tiles being positioned further apart than may be desired for certain visual applications. This is because the stem passes between the parallel edges of the adjacent tiles, and defines the space between the installed tiles. Excessively wide grout joins are generally considered to be unsightly and not contemporary. In addition, if the stem is too thick, there will be minimal flex of the stem and/or end of the head adjacent to the opening, as the wedge is inserted. A small amount of flex of the stem is generally considered to be desirable for optimal user experience for the installer, and to achieve optimal performance. The flex of the stem tends to provide a countering force to keep applying a downward load on the upper surface of the tiles while the adhesive is setting.

In contrast, if the stem is excessively thin, whilst very thin grout joints may be achieved, in practice, there will be too much flex in the stem as the wedge is inserted, and there is a risk that the stem will snap during loading. An excessively thin stem can result in several problems. Firstly, it may limit the ability of the clip and wedge to generate a sufficient holding force to pull the adjacent tile edges into a common plane. Secondly, if there is too much flex, it may be difficult to physically drive the wedge to the desired position. This is because, when the wedge is inserted, the wedge is normally pushed in a forward direct, while the user pulls back against the top of the clip. If the clip flexes rearwardly too much during this procedure, it may prevent the wedge from reaching the intended final point where a sufficient degree of loading is applied to the tiles to pull them into alignment.

One existing clip and wedge system utilises a stiffening rib along the upper edge of the opening. The stiffening rib serves to stiffen the opening, locally minimising the amount of flex. However, it does not address the issue of larger than desired flex in the stem. Furthermore, some flex along the upper edge of the opening may be desirable.

OBJECT OF THE INVENTION

It is an object of the present invention to substantially overcome or at least ameliorate one or more of the above disadvantages, or to provide a useful alternative.

SUMMARY OF THE INVENTION

The present invention provides a tile levelling device comprising:

a base portion having an upper surface and an opposing lower surface, the lower surface being substantially planar;

two stems each having a proximal end frangibly connected to the base portion and a distal end connected to a body, a generally rectangular hole being defined by the stems the base portion upper surface and the body, the hole being adapted to receive a wedge; and a stiffening formation located at or near the interface between each stem and the body.

The stiffening formation preferably includes a stiffening rib located on at least one side of each stem and body interface defining a region increased thickness.

The stiffening rib preferably has a first cross-sectional area closest to the hole, and a second, larger cross-sectional area furthest from the hole, the first and second cross-sectional areas being viewed through a plane with is generally perpendicular to the body and also perpendicular to the base portion.

The stiffening rib preferably has a generally trapezoidal shape when viewed in a plane which extends parallel to the body.

Each trapezoidal shaped stiffening rib preferably has a smallest side located at a junction between the stem and the body, the smallest side being contiguous with an edge of the stem defining the hole.

Each trapezoidal shaped stiffening rib preferably has a longest side being parallel with the smallest side, wherein the longest side is contiguous with an edge of the stem furthest from the hole.

A lowermost portion of each stiffening rib preferably is located beneath the interface between each stem and the body.

An uppermost portion of each stiffening rib is preferably located above the interface between each stem and the body and tapers to an apex.

The stiffening rib is preferably located on each side of each stem and body interface.

The tile levelling device further preferably includes at least one step located between the stems and the stiffening formation.

One or more recesses are preferably formed in the upper surface of the base portion, and the proximal end of each stem is secured to the base portion at or near a low point of said recess.

The body preferably includes rounded projections adapted to provide an impact point for separating the stem from the base portion.

The upper surface of the base portion includes one or more adhesive bonding channels.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

A tile levelling device 10 according to the invention includes a clip 11 which is disclosed in FIGS. 1, 2, 3, 5 and 6. The tile levelling device 10 also includes a wedge 50 which is disclosed in isolation in FIG. 4. The tile levelling device 10 assists in both levelling and spacing tiles 40 during installation. The device 10 can be used with various surfaces such as floors and walls.

Figure 1:
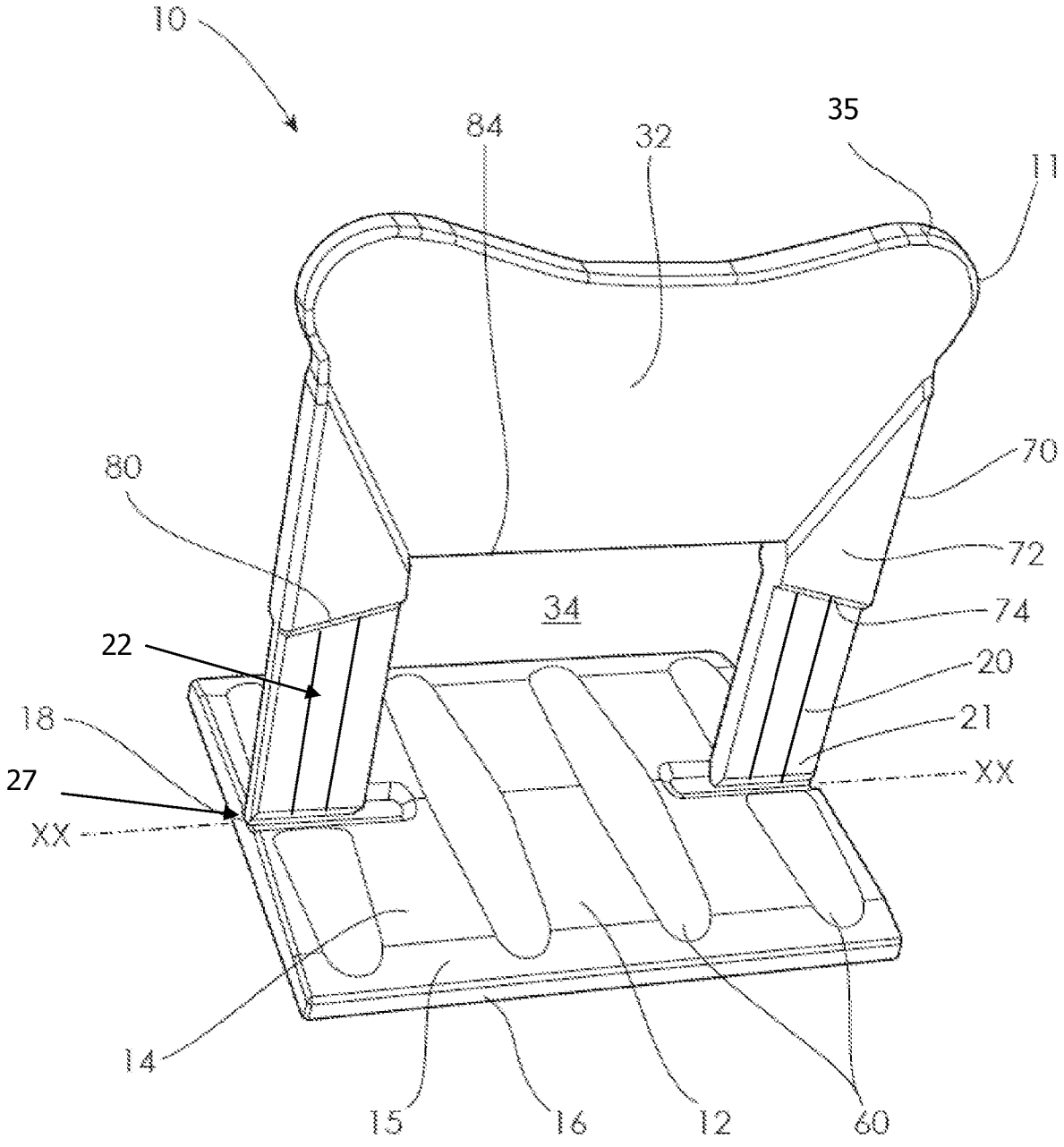
FIG. 1 is a perspective view of a clip of a tile levelling device according to the invention.

As shown in FIG. 1, the tile levelling device 10 includes a generally rectangular base portion 12 having an upper surface 14 and an opposing underside surface 16. Two depressions or recesses 18 are formed in the upper surface 14. The recesses 18 are located on the centre line XX of the base portion 12. Before or during the laying of tiles 40, the device 10 is located with the base portion 12 located underneath two adjacent tiles 40, such that the centre line XX extends along and parallel with the space between the two tiles 40.

An upper portion 30 of the tile levelling device 10 has a body 32 connected to two arms or stems 20. The stems 20 each have a proximal end which is frangibly connected to the base portion 12. In the preferred embodiment, the stems 20 are connected to the base portion at or near a low point of the recesses 18, such that in use, the stems 20 separate from the base portion 12 beneath the upper surface 14.

Referring to FIG. 1, on each of the front and rear surfaces of the stems 20, there us a raised rib 22. The ribs 22 provide a small increase if stiffness of the stems 20.

A generally rectangular hole 34 is formed in the device 10. The hole 34 is bounded on two sides by the stems 20, bounded on one side by the body 32 and bounded on one side by the base portion 12. The hole 34 is adapted to receive a wedge 50, shown in isolation in FIG. 4.

Figure 2:
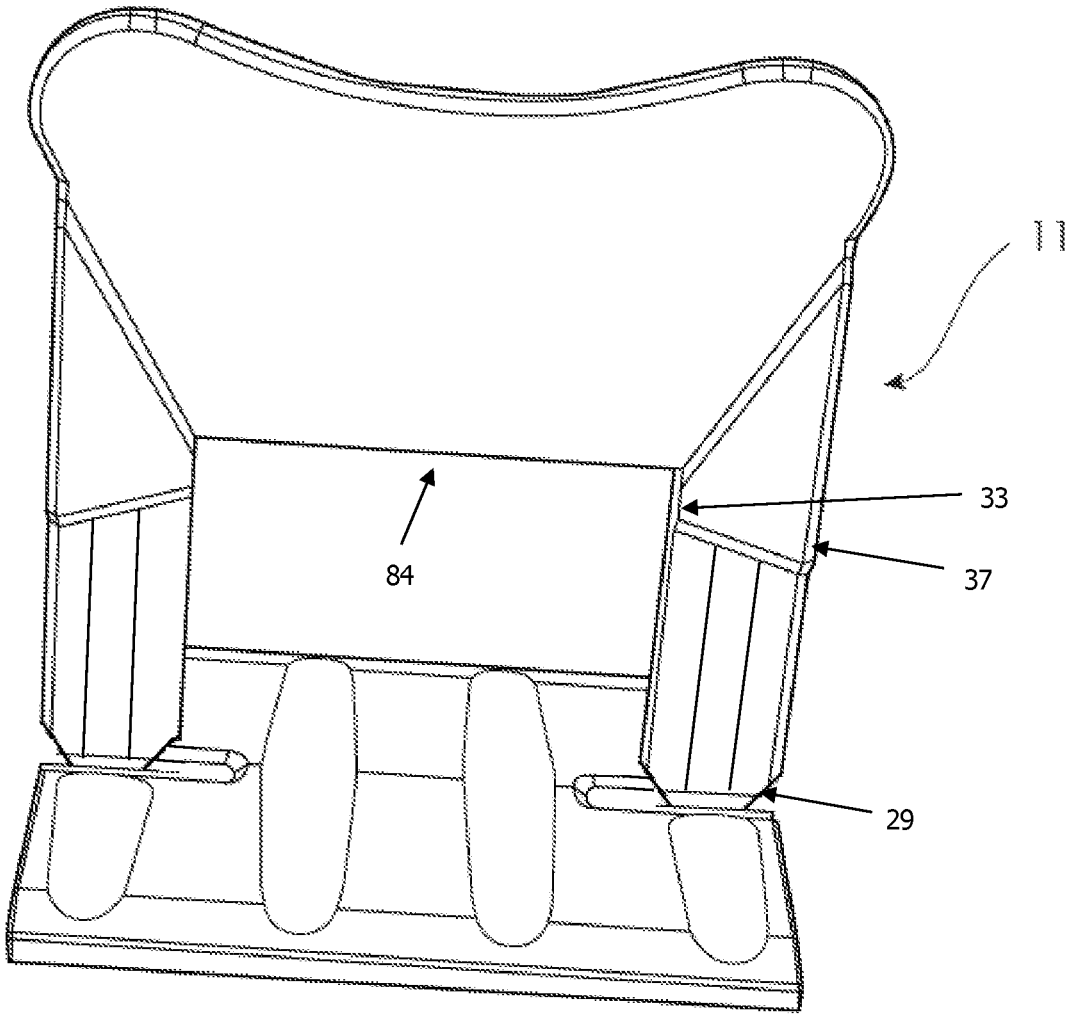
FIG. 2 is a front view of the clip of FIG. 1.
Figure 3:
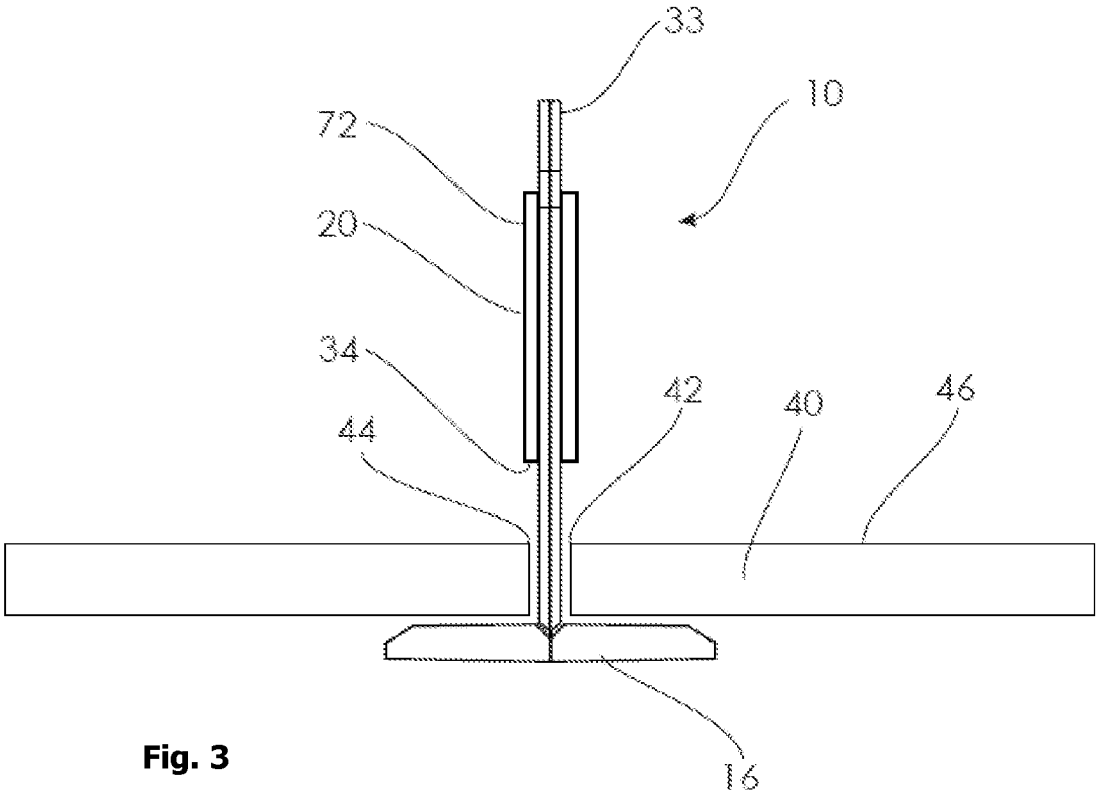
FIG. 3 is a side view depicting the clip of FIG. 1 located between two tiles.
Figure 4:
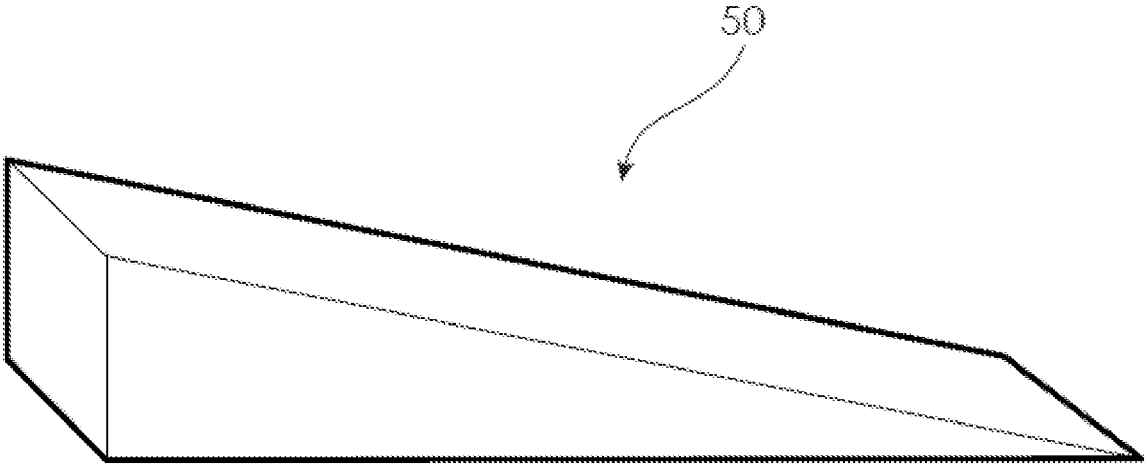
FIG. 4 is a perspective view of a wedge of the tile levelling device.

As depicted in FIG. 3, when two adjacent tiles 40 are located above the base portion 12, the hole 34 extends above the upper surfaces 46 of the tiles 40, permitting the wedge 50 to be driven into the hole 34. The hole 34 and wedge 50 are sized to accommodate tiles of differing thicknesses. As depicted in FIG. 2, the stems 20 project between the adjacent edges 42, 44 of the tiles 40. The device 10 is provided in 2 or more different sizes to accommodate different thickness tiles. The difference between the different models concerns the vertical height of the holes 34 and stems 20.

As shown in FIGS. 1 and 2, the recesses 18 are in the form of elongate channels which have a generally "V" shaped profile when viewed along the axis XX, or alternatively a "V" shaped profile with the apex flattened to define a channel with a flat base and two inclines side walls.

The length of the channels 18 is greater than the width of the stems 20 in a direction extending along axis XX. Accordingly, the additional length of the recesses 18 provides a clearance during separation of the stems 20 from the base portion 12, as the body 32 is impacted in a direction extending generally parallel to the axis XX.

The proximal or lower most portion 21 of each stem 20 has a frangible region 23 extending parallel to the axis XX. The lowermost stem portion 21 is integrally formed with and secured to a base of the channels 18. The frangible region 23 at the lowermost stem portion 21 is narrower than the width of the depression 18. This enables the stem 20 to pivot clockwise or counter clockwise relative to the base portion 12 about the axis XX. The frangible region 23 includes a frangible web 27 which is integrally formed between the base of the channels 18 and the lowermost stem portion 21.

The proximal end of each stem 20 above the frangible web 27 is tapered of chamfered 29 as depicted in FIG. 2. The chamfer 29 serves the purpose of reducing the thickness of the frangible web 27 along the axis XX, and hence reduces the breaking force required to separate the stems 20 from the base portion 12.

The upper, generally opposing corners of the body 32 include rounded projections or lugs 35 which provide an impact point for separating the stems 20 from the base portion 12. This may be by way of impact from a hammer, from kicking or another suitable tool.

The upper surface 14 of the base portion 12 includes one or more adhesive bonding channels 60 which assist to secure the base portion 12 in the desired location during laying of the tiles 40. The channels 60 extend generally perpendicular to the axis XX, and hence are perpendicular to the seam line between the adjacent tiles 40.

Bevelled edges 15 are present on the sides of the base portion 12. The bevelled edges 15 assist when pushing the base portion 12 under a tile 40 into the adhesive, and directing the adhesive over the base portion 12 into the channels 60.

The tile levelling device 10 includes flex bars or stiffening ribs 70. The flex bars 70 are provided in the form of projections or stiffening ribs which provide a localised increase of cross-sectional area. The flex bars 70 are located at or near the interface between the body 32 and the stems 20, generally adjacent to the two upper corners of the rectangular hole 34.

In the embodiment depicted in the drawings, the flex bars 70 are provided in the form of four generally trapezoidal projections 72, such that one of the projections extends laterally from each side of each stem 20, on either side of the axis XX. As such, the projections 72 define a local thickened portion of the stem 20 and body 32, which is more resistant to bending. The location of the flex bars 70 in a horizontal direction may be slightly different to the embodiment shown in the drawings.

The flex bars or stiffening ribs 70 enable the tile levelling device 10 to be loaded, such that a recoil effect occurs, resulting in downward force to be applied to the top surface of the tile. The downward force continues due to flexing of the device 10 after the wedge 50 has been inserted.

The recoil or flex force assists with placement, and in practice this means that the wedge 50 can be inserted into the hole 34 by hand, and the use of a mallet or other impact tool is not necessary. In contrast, the increased rigidity of the prior art systems normally requires that the wedges are inserted with a mallet or other such impact tool. As such, the tile levelling device 10 enables significant initial flexing and recoiling properties when the wedge 50 is being forced through the hole 34 via either a thumb or forefinger, negating the need to use impact tools.

The load applied to the upper section of the clip 11 at the rounded projections or lugs 35 is applied by the installers hand or pliers, and a similar load is also applied to the wedge 50 causing the upper portion of the body 32 of the clip 11 to fold back. This folding reaction is then quickly followed by the trapezoidal sections offering the reverse recoil action and down force at the hole 34 of the clip 11, to add consistent and ongoing pressure to the top of wedge 50. That force is then applied onto to tiles.

As shown in FIGS. 1 and 2, the flex bars 70 are shaped such that there is a small but minimal increase in thickness at or near the interface between the stems 20 and the body 32. The area of each projection 72 increases along the XX axis, such that the region of greatest rigidity and cross sectional area is located at the edge of each stem 20 which is furthest from the opening 34.

In the embodiment depicted in the drawings, the flex bars 70 are trapezoidal, with the smallest side 33 being contiguous with the vertical side of the hole 34. Furthermore, the longest side 37 of the trapezoid is located opposite the smallest side 33, and is contiguous with the outer edge of the stem 20. The smallest side 33 of the trapezoid extends from the corner of the hole 34 vertically downward, around 2 mm-4 mm.

It will be appreciated that the shape of the flex bars 70 may be provided in shapes other than trapezoidal. For example, each projection 72 may be triangular, with an apex located at or near the interface of the stem 20 and the body 32. Alternatively, the flex bars 70 may be in the form of a segment of a circle, or some other arcuate shape.

The flex bars 70 have a cross sectional profile when viewed in the front view (in a plane extending parallel with the body 32), such that the width of the flex bar 70 tapers or otherwise narrows from a widest region, located at or near the lower edge 84 of the body 32, to a flex bar apex or end point located above the lower edge 84 of the body 32. This results in the flex force generated by the flex bars 70 being variable, and reducing toward the flex bar apex or end point.

Importantly, the lowermost portion of the flex bar 70 is located vertically beneath the lower edge 84 of the body 32. This prevents or at least inhibits the bending of the clip 11 from occurring along a line corresponding in vertical position with the lower edge 84 of the body 32. Accordingly, the flexing of the flex bar 70 results in the vertical height of the hole 34 being reduced, and this accordingly increases the force applied to the wedge 50.

Advantageously, the lowermost region of each flex bar 70 is positioned a suitable distance from the base portion 12. That distance is at least larger than the thickness of the tile and typical adhesive thickness plus a small margin. In use, this means that the flex bar 70 does not contact the tiles at any stage, and does not have any effect on the spacing at which adjacent tiles can be positioned.

Importantly the shape of the flex bars 70 provides stiffening of the two opposing lateral portions of body 32, and stiffening of the upper portion of each stem 20.

The flex bars 70 provide stiffening along the lateral sides of the body 32. In particular, the stiffening operates in a vertical direction, preventing or at least inhibiting bending about an axis which is parallel to the axis XX.

Figure 5:
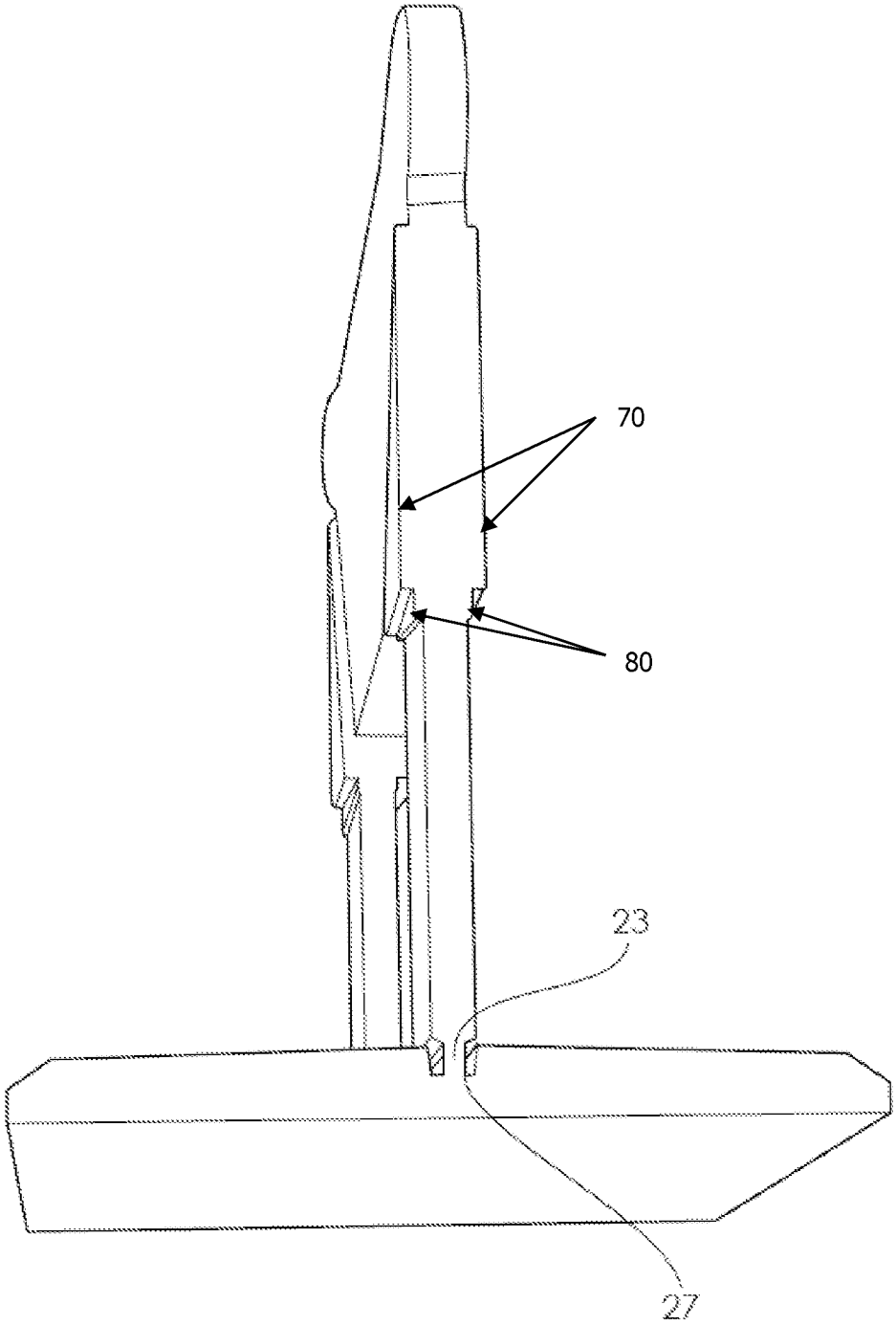
FIG. 5 is a side view of the clip of FIG. 1.

Referring to FIG. 5, the flex bars 70 may include an additional step or other such formation, 80 which acts as a transition between the regular thickness of the stem 20, and the thickness of the stem 20 and body 32 at the location of the bolstered flex bar 72. The transition from the reduced to increased thickness may occur in a single step, in two steps (as depicted in FIG. 5) or in a gradual manner to blend smoothly between the two thicknesses.

The operation of the tile levelling device 10 will now be described. When the wedge 50 is driven into the hole 34, the wedge 50 eventually comes into contact with the lower edge 84 of the body 32. By applying further force, either by hand or with a tool such as a mallet, the wedge 50 deforms the lower edge 84 of the body 32, such that the lower edge 84 is displaced in a direction toward the front of the wedge 50.

The lower edge 84 is tapered on each side to a point, which improves engagement with grooves formed on the upper engagement surface of the wedge 50.

In existing tile levelling devices, during load application by the wedge, there is a tendency for the body and stems to significantly bend into a curved profile, when viewed from the side, such that the upper portion of the body 32 is closer to the trailing end of the wedge. However, the operation of the flex bars 70 partially resists such bending and deformation, meaning excessive bending is avoided, and the risk of failure at the interface between the body 32 and the stems 20 is minimised. Furthermore, the flex bars 70 prevent the body 32 from bending or deforming in a non-planar manner, as the flex bars 70 provide lateral support along the edges of the body 32.

Importantly the tile levelling device 10 permits some degree of deformation of the body 32 toward the rear of the wedge 50, once a suitable loading is reached. This deformation means that the lower edge 84 continues to provide a downward force on the wedge, and hence continues while the tile adhesive sets. This is important, as it means that if the adhesive shrinks slightly, the levelling force is not significantly reduced or removed completely. This significantly reduces the risk of the tiles coming out of the intended alignment during adhesive setting.

Figure 6:
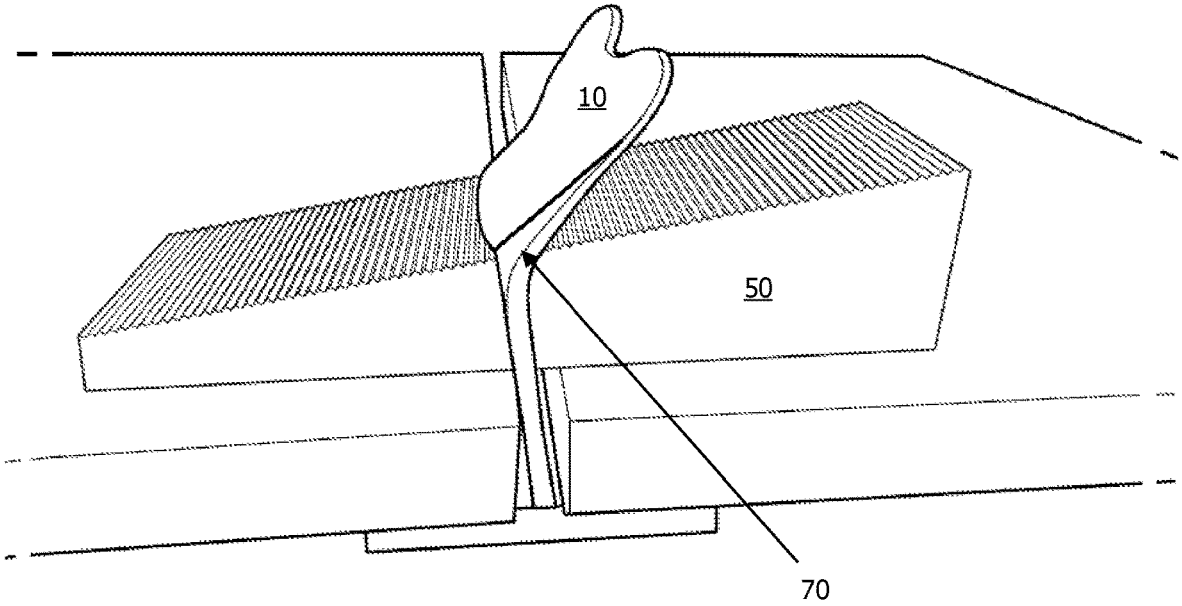
FIG. 6 is a side view of the clip of FIG. 1 when loaded with a wedge.

When the wedge 50 is forced by the tiler through the hole 34, the intersection of the vertical stems 20 and the lower edge 84 of the body 32, which defines the upper side of the hole 34, buckles under the force of the wedge 50 and the upper portion of the body 32 of the clip bends or folds rearwardly and the horizontal, lower edge 84 of the body 32 moves forward with the wedge 50. This position is depicted in FIG. 6. This elasticity assists the operation of the tile levelling device 10. In particular, once the wedge 50 is set, the clip 11 then slowly deforms in a reverse direction, to tighten the wedge 50 against the upper surface of the tiles by reversing the motion and applying a downward pressure. This elasticity and slow deformation enables the tile levelling device 10 to provide improved performance when compared with prior art systems which are stiffer and generally include stiffening ribs across the upper side of the opening, as such prior art systems do not allow for any flex (or sufficient flex) of the top part of the clip or the horizontal opening and accordingly, no further down ward force is applied by the clip once the wedge is inserted manually to its final position.

The desirable flex characteristic is a result of the flex bars 70, and partially on account of the lower portion of the flex bar 70 being positioned beneath the lower edge 84 of the body 32, defining the upper edge of the hole 34.

Advantageously, the flex bars 70 enable continued movement of the clip 11 by elastic deformation after the insertion of the wedge 50. The shape of the thickened portions which define the flex bars 70 permit the initial buckling and folding of the clip 11. On account of the thickened flex bars 70 being longer on the outside, lateral vertical edge and coming into a vee-shape, and a region of smallest cross-sectional area through a vertical plane, at the intersection of the stems 30 and horizontal lower edge 84 of the body 32, this creates a more pronounced spring action and increased downward force on the tiles during the adhesive curing stage.

Furthermore, the flex bars 70 provide significantly increased lateral stiffening of the clip 11. As such, when the upper portion (stems 20 and body 32) is being removed with a hammer or by kicking, there is improved rigidity, and reduced likelihood of undesired lateral or asymmetric buckling.

The lower edge 84 of the body 32 moves slightly forward, on account of elastic deformation, in a direction toward the leading end of the wedge 50.

In one embodiment, a small cut-out or aperture such as a vertically extending notch may be provided at the junction of the flex bars 72 and the lower edge 84 of the body 32. This notch provides a greater degree of elasticity or flexibility of the lower edge 84, meaning that there is locally more compliance and resilient deformation along the lower edge 84, to be elastically deformed by the wedge 50, which has a grooved or stepping upper surface, with the grooves extending parallel to the axis XX.

In one embodiment, the upper, sloped surface of the wedge 50 includes generally parallel groves, which are curving in profile when viewed generally from above, defining a plurality of curving channels. The curvature of the channels is designed to correspond with the curvature of the lower edge 84 of the body 32 of the clip 11 when loaded. This assists to spread the load more evenly across the width of the wedge 50, and thereby reduce the amount of localised wear on the wedge 50. In this manner, the usable life of the wedge 50 may be extended.

The tile levelling device 10 is manufactured from a polymer and is formed in an injection moulding process.

Advantageously, the tile levelling device 10 with flex bars 72 can be manufactured with thinner stems 20 than a comparable tile levelling device 10 without flex bars 72. This means that narrower joins between adjacent tiles can be achieved, which is aesthetically preferable in many applications.

The break point or web 27 is located below the upper surface 14 of the base portion 12 so that when the body 32 of the levelling device 10 is removed there is nothing protruding between the base plate 12 and tile seam. This is beneficial as it helps with expansion between tiles.

Advantageously, the stems 20 are able to pivot about the base of the recesses 18. This permits the body 32 to tilt as the wedge 50 is driven into the hole 34, to achieve a strong locking force to pull the adjacent tiles 40 into alignment.

Although the invention has been described with reference to specific examples, it will be appreciated by those skilled in the art that the invention may be embodied in many other forms.

The invention claimed is:

1. A tile levelling device comprising:

a base portion having an upper surface and an opposing lower surface, the lower surface being substantially planar;

two stems each having a proximal end frangibly connected to the base portion and a distal end connected to a body, wherein a generally rectangular hole is defined by the stems, the upper surface of the base portion, and the body, the hole being adapted to receive a wedge; and a stiffening formation located at respective interfaces between the two stems and the body, wherein the stiffening formation defines a region of increased thickness and includes a stiffening rib located on at least one side of each interface respectively positioned between the two stems and the body, wherein each stiffening rib has a first cross-sectional area closest to the hole, and a second, larger cross-sectional area furthest from the hole, the first and second cross-sectional areas being viewed through a plane which is generally perpendicular to the body and also perpendicular to the base portion, further wherein each stiffening rib has a trapezoidal shape when viewed in a plane which extends parallel to the body, each stiffening rib including a smallest side located at respective junctions between the two stems and the body, the smallest sides being contiguous with respective edges of the two stems defining the hole, further wherein each stiffening rib has a longest side being parallel with the smallest side, and wherein the longest sides are contiguous with respective edges of the two stems furthest from the hole.

2. The tile levelling device of claim 1, wherein a lowermost portion of each stiffening rib is located beneath each of the interfaces respectively positioned between the two stems and the body.

3. The tile levelling device of claim 2, wherein an uppermost portion of each stiffening rib is located on each side of the interfaces respectively positioned between the two stems and the body.

4. The tile levelling device of claim 1, wherein the stiffening ribs are located on each side of the interfaces respectively positioned between the two stems and the body.

5. The tile levelling device of claim 1, further including at least one step located between the two stems and the stiffening formation.

6. The tile levelling device of claim 1, wherein one or more recesses are formed in the upper surface of the base portion, and the proximal end of each stem is secured to the base portion at a low point of said recess.

7. The tile levelling device of claim 1, wherein the body includes rounded projections adapted to provide an impact point for separating the two stems from the base portion.

8. The tile levelling device of claim 1, wherein the upper surface of the base portion includes one or more adhesive bonding channels.

* * * * *